United States Patent [19]

Dufour et al.

[11] Patent Number: 4,842,925

[45] Date of Patent: Jun. 27, 1989

[54] PROCESS TO MANUFACTURE A FELT WITH FLAP AND A FELT PRODUCED THEREBY

[75] Inventors: Marcel Dufour, Saint Yrieix; Jacques Piat, Fléac, both of France

[73] Assignee: Asten Group, Inc., Charleston, S.C.

[21] Appl. No.: 162,807

[22] Filed: Mar. 1, 1988

[30] Foreign Application Priority Data

Mar. 2, 1987 [FR] France ..... 87 02776

[51] Int. Cl.[4] ..... D21F 7/10; D04H 1/46

[52] U.S. Cl. ..... 428/223; 28/110; 28/141; 28/142; 139/383 A; 162/199; 162/272; 162/358; 162/DIG. 1; 428/222; 428/300; 428/234; 428/280; 428/282

[58] Field of Search ..... 162/199, 200, DIG. 1, 162/273, 358, 348; 139/383 AA, 383 A; 28/141, 142, 110; 156/148, 159, 258, 304.1, 304.3–304.7; 428/300, 222, 223, 234, 280, 282; 24/33 P, 33 B, 33 C

[56] References Cited

U.S. PATENT DOCUMENTS

| | | | |
|---|---|---|---|
| 2,907,093 | 10/1959 | Draper, Jr. | 28/141 |
| 4,476,902 | 10/1984 | Westhead | 162/DIG. 1 |
| 4,481,079 | 11/1984 | Dawes | 162/DIG. 1 |
| 4,528,236 | 7/1985 | Finn et al. | 428/222 |
| 4,574,435 | 3/1986 | Luciano et al. | 139/383 AA |
| 4,601,785 | 7/1986 | Lilja et al. | 162/199 |
| 4,683,624 | 8/1987 | Dufour | 28/141 |
| 4,755,260 | 7/1988 | Sakuma | 162/199 |

FOREIGN PATENT DOCUMENTS

| | | |
|---|---|---|
| 0108733 | 5/1984 | European Pat. Off. . |
| 0193075 | 3/1986 | European Pat. Off. . |

OTHER PUBLICATIONS

Landis, John, L., "Mechanics of Patent Claim Drafting", 1974, Cover and p. 169.

*Primary Examiner*—Karen Hastings

*Attorney, Agent, or Firm*—Volpe and Koenig

[57] ABSTRACT

Process of manufacturing a papermakers' wet press felt for the wet end and a felt produced thereby with one or two flaps (14, 10), made of two batts (12, 13) needled onto each side of the felt (1), which ends in two rows of loops (4, 5) that are intended to seam the felt, characterized in that the rows of loops (4, 5) are joined during needling by temporary, removable connecting means (6) placed in relation to the flap(s) (14, 16) which have a greater width than the widths of the finally cut flaps (14, 16).

The flap(s) (14, 10) are not damaged during the needling operation and are easily loosened without damage by removing the spiral (7) which form the temporary joining means (6).

24 Claims, 1 Drawing Sheet

PROCESS TO MANUFACTURE A FELT WITH FLAP AND A FELT PRODUCED THEREBY

BACKGROUND OF THE INVENTION

The present invention relates to a process of manufacturing a felt, and a felt produced thereby, for the wet end with one or two flaps made of needled batts on each side of the felt, which ends in two rows of loops intended to be connected and locked together for the operation of the felt.

Such a process of manufacturing a wet felt with flap is described in the EP-A-No. 108733 document. According to this process, the two rows of loops of the felt are joined together with a pintle wire, then an upper batt and a lower batt of flexible fibers are needled onto the felt.

In this known process, a flap is made by cutting the needled batt near the seam, and then detaching the part of the batt that covers the seam. By doing so, this flap is damaged because the prior needling process ties the flap to the felt and to the batt located on the other side. By detaching the needled flap, it is partially destroyed. This is even more evident when the batt is made of several superimposed layers and when the flap is part of a layer that is placed on top of other layers, because pulling a needled layer off another layer does significant damage to the portion that is pulled off.

The process according to the invention makes it possible to obtain a flap that covers the area of the seam and is not damaged by needling, characterized in that the rows of loops are connected during needling by removable joining means placed in relation to the flap(s), and the width of which is greater the width of the flap(s).

SUMMARY OF THE INVENTION

The invention comprises a process of producing a papermakers' wet press felt and a felt produced in the process. The invention is the process of manufacturing a felt for the wet end with one or two flaps (14, 10) made of two batts (12, 13) needled onto each side of the felt (1), which ends with two rows of loops (4, 5) intended to seam the felt, characterized in that the rows of loops are joined during needling by removable connecting means (6) placed in relation to the flap(s) (14, 16), and which have a larger width than the widths of the flap(s) (14, 16).

DESCRIPTION OF THE PREFERRED EMBODIMENTS

Figure 1:
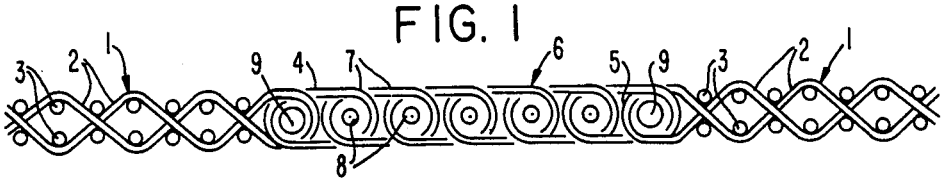
FIG. 1 represents the felt without batts, joined together by spirals which form a temporary or removable joint.

According to the process of the invention, one uses a woven felt, i.e. open base fabric (1) made of warp yarn (2) that is intertwined with weft yarn (3), said felt having a first row of loops (4) and a second row of loops (5) at its two ends. When the felt is finished, these two rows of loops, after they are brought together, are intended to form a channel into which a seaming pintle wire is inserted.

Figure 2:
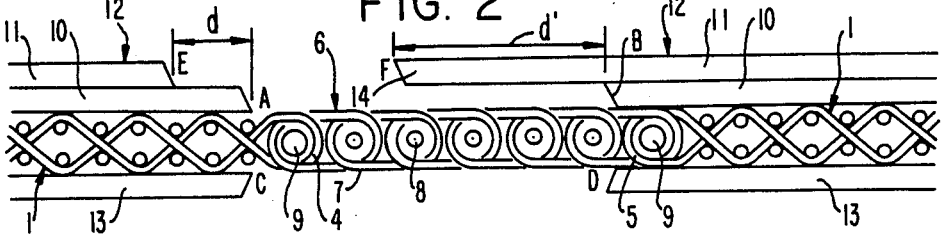
FIG. 2 represents the arrangement of the batts onto the felt of FIG. 1 prior to needling the set to a flap during the manufacturing process of the felt.
Figure 4:
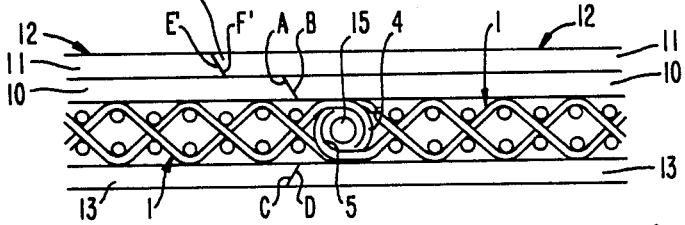
FIG. 4 represents the felt in FIG. 3 after seaming and final cutting of the flap.

These two rows (4 and 5) are joined by a temporary joining band (6) made of several rows (7) of spirals. The spirals are of a thermosettable material, which will be known to those skilled in the art, and have sufficient strength to retain the fabric ends during processing. The spirals are provided in sufficient number to equal a width, as seen in FIG. 2, which is greater than the width of the final flap, as seen in FIG. 4. Stated another way, at least one batt layer extends in a flap of a selected dimension substantially beyond the rows of loops (4, 5) of one end of the base fabric. The rows of loops are joined during needling by a temporary or removable connecting means (6) which spans between the rows of loops with a dimension greater than the selected dimension of the flap such that the flap does not cover the entire temporary connecting means.

These rows (7) are connected with each other by yarn (8) of a plastic material which should preferably be soluble in a solvent (for example, yarn sold under the trademark "Solvron"), and the two rows at the end of the fabric are joined to the rows of spirals by piano cords or suitable pintles (9) (see FIG. 1). In general, the spirals (7) and yarns (8) should be of a more brittle material which will be fragmented in the subsequent needling operation or soluble in a medium which is not destructive of the felt (1) or the batt layer(s) (10, 11, 13).

Referring to FIG. 2, one takes a first layer (10) of flexible fibers or batt material which is needled on top of the felt (1); this layer (10) starts from point A behind the row of loops (4) and continues around the felt (1) to point B in front of the row of loops (5). At point A, the layer is cut at an angle pointing up and away from the row (4); at point B, the layer is cut according to a reverse angle that complements the angle from point A.

One takes a second layer (11) of flexible fibers or batt material which is needled onto the first layer (10) between a point E that is set back from point A, by e.g. one warp pattern (2) of the felt which is equal to about 10 mm, and continues around the felt (1) to a point F which extends beyond point B by a distance d', which is for example 20 mm longer than d to form a flap (14). These two layers (10 and 11) constitute the upper batt (12).

On the back of the felt, one needles a third layer (13) by starting at point C, which is generally positioned vertically below point A, around the felt (1) to point D, generally located at end of the band (6) and vertically below point B (see FIG. 2).

Next, several needling passes are applied to the face and the back of the felt (1), with its upper batt consisting of layers 11 and 12 and its bottom batt composed of layer 13.

During needling, the flaps are loosely joined across the spirals of band 6. Although there is some damage to the spirals 7) and the yarns (8), there remains sufficient strength to process the felt (1). The fibers of flap 14 and flap 16 do not mingle inside the spirals (7); on the other hand, in the absence of the spirals of band 6, these fibers would intermingle with each other inside loops (4 and 5), the felt (1) and also with the layer (10).

By means of this needling operation, the threads (8) are fragmented or destroyed, and the rows of spirals can be pulled out very easily. If soluble yarns are used and the threads (8) are not completely destroyed, one soaks the threads in a solvent, for example water if Solvron threads were used, and the spirals are released from each other. Due to the loose binding the temporary band 6 is easily removed and the space for interconnecting the loops (4, 5) has been preserved.

Figure 3:
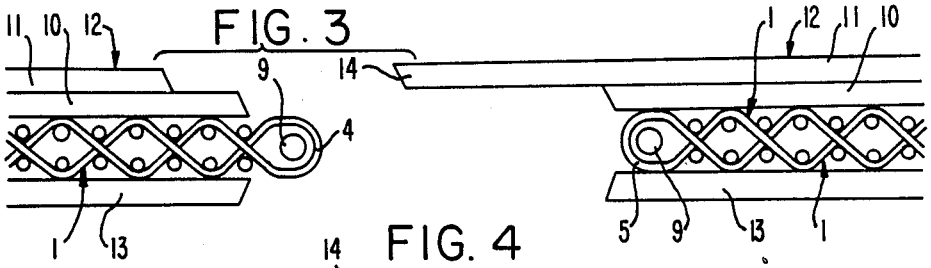
FIG. 3 represents the felt in FIG. 2 after removal of the spirals which form the temporary joint.

In this manner, the flap, that was not damaged during the various needling steps, is set free and the process of loosening it is accomplished without any damage to the flap (see FIG. 3).

One then seams the two rows of loops (4, 5) together by moving them into each other so as to form a joint channel into which a permanent pintle wire (15) is inserted.

The flap (14) is then finally cut in such a way that its extremity F′ which is cut at an angle, fits against and makes contact with extremity E′, which is also finally cut at an angle which complements F′.

This way, when the rows of loops are seamed, point A makes contact with point B and point F′ with point E′ in such a way that layer 10 and layer 11 have an even caliper in the seam area. In the same way, point C makes contact with point D so that the caliper of layer 13 is also even (see FIG. 4).

Figure 5:
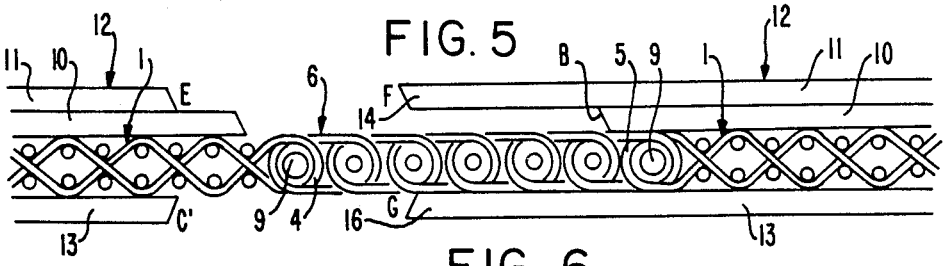
FIG. 5 represents an alternative placement of the batts on the felt prior to needling the set during the manufacturing process of the felt.
Figure 6:
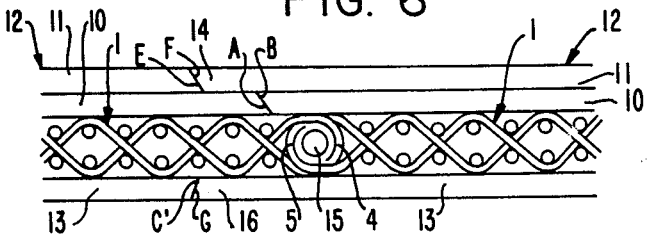
FIG. 6 represents the felt in FIG. 5 after seaming and cutting the flaps.

In the event that one also wants to make a flap with layer 13, layer 13 is stopped at a certain distance behind that row (4), for example at point C′ generally vertically below E, then the layer (13) is continued beneath the band (6) where it arrives at G to form a flap (16) (see FIGS. 5 and 6).

It follows that it is easy to pull the flaps 14 and 16 without damaging them.

All that is left to do, is to finally cut them at the right length so that the upper batts (12) and the lower batt (13) have the same caliper (see Figure).

Preferably, one can take predensified batts for layers 11, 12, and 13 that were obtained by running them several times on the face and the back through a needling machine and process, as described in the U.S. Patent Application Ser. No. 162,556 "Process for Manufacturing Wet Felts and Machine to Densify Batts", filed at 3/01/88 in the name of the applicants.

Moreover, we have presented felts with two layers on top and one layer on the bottom, but one could also use any number of layer on top and on the bottom.

What I claim is:

1. Process of manufacturing a papermaker's felt having at least two batts (12, 13), one needled onto each side of a base fabric which has two ends, each end including a row of loops (4, 5), for seaming the felt, characterized by extending at least one of the batts in a flap of a selected dimension substantially beyond the row of loops of one end of the base fabric and joining the rows of loops during needling by temporary connecting means (6) which spans between the rows of loops with a dimension greater than the selected dimension of the flap such that the flap does not cover the entire temporary connecting means.

2. Manufacturing process according to claim 1, characterized in that the temporary means consists of spirals (7) which are connected together by threads (8).

3. Manufacturing process according to claim 2, characterized in that the threads (8) that connect the spirals (7) are plastic threads.

4. Manufacturing process according to one of the claims 2 and 3, characterized in that the threads (8) that connect the spirals (7) are soluble threads.

5. Manufacturing process according to one of the claims 2 and 3, characterized in that the threads (8) and spirals (7) are soluble plastic threads.

6. Manufacturing process according to one of the claims 2 and 3, characterized in that the batts (12, 13) each comprise at least one layer of batt material which is predensified through a needling process prior to being needled onto the felt (1).

7. Manufacture process of claim 4 characterized in that the batts (12, 13) each comprise at least one layer of batt material which is predensified through a needling process prior to being needled onto the felt (1).

8. Manufacturing process according to claim 1, characterized in that the temporary means are removable.

9. An improved seamed papermaker's wet end felt, of the type having an open base fabric terminated at each end thereof in a row of complementary seam loops with at least one layer of batt material needled onto each side of the base fabric, said improvement characterized by at least one of said layers extending in a flap of a selected dimension substantially beyond the row of loops of one end of the base fabric, and removable connecting means interconnected with the seam loops at each end of the base fabric which spans between the rows of loops with a dimension greater than the selected dimension of the flap such that the flap does not cover the entire removable connecting means.

10. The felt of claim 9 wherein said removable connecting means is comprised of spirals which are joined together by threads.

11. The felt of claim 10 wherein the threads that join the spirals are plastic threads.

12. The felt of claim 11 wherein the threads that join the spirals are soluble threads.

13. The felt of claim 10 wherein the batt material is predensified.

14. The felt of claim 10 wherein the threads that join the spirals are soluble threads.

15. The felt of claim 14 wherein the batt material is predensified.

16. An improved method of seaming papermaker's wet end felt, of the type having an open base fabric terminated at each end thereof in a row of complementary seam loops with at least one layer of batt material needled onto each side of the base fabric, said improvement characterized by extending at least one of said layers in a flap of a selected dimension substantially beyond the row of loops of one end of the base fabric, and providing removable connecting means interconnected with the seam loops at each end of the base fabric as a non-permanent seam which spans between the rows of loops with a dimension greater than the selected dimension of the flap such that the flap does not cover the entire connecting means.

17. An improved seamed papermaker's wet end felt, of the type having an open base fabric terminated at each end thereof in a row of complementary seam loops with at least one layer of batt material needled onto each side of the base fabric, said improvement characterized by said at least one batt layer on each side of the felt extending in flap of a selected dimension substantially beyond the row of loops of one end of the base fabric and removable connecting means positioned between said extending flaps and interconnected with the seam loops at each end of the base fabric which spans between the rows of loops with a dimension greater than the selected dimension of the flaps.

18. The felt of claim 17 wherein said removable connecting means is comprised of spirals which are joined together by threads.

19. The felt of claim 18 wherein the threads that join the spirals are plastic threads.

20. The felt of claim 19 wherein the threads that join the spirals are soluble threads.

21. The felt of claim 18 wherein the batt material is predensified.

22. The felt of claim 18 wherein the threads that join the spirals are soluble threads.

23. The felt of claim 22 wherein the batt material is predensified.

24. An improved seamed papermaker's wet end felt, of the type having an open base fabric terminated at each end thereof in a row of complementary seam loops with at least one layer of batt material needled onto one side of the base fabric, said improvement characterized by said at least one batt layer extending in a flap of a selected dimension substantially beyond the row of loops of one end of the base fabric and removable connecting means with a dimension greater than the selected dimension of the flap interconnected with the seam loops of each end of the base fabric.

* * * * *

UNITED STATES PATENT AND TRADEMARK OFFICE

CERTIFICATE OF CORRECTION

PATENT NO. : 4,842,925

DATED : June 27, 1989

INVENTOR(S) : Marcel Dufour, et al

It is certified that error appears in the above-identified patent and that said Letters Patent is hereby corrected as shown below:

Column 3, line 33, delete the word "that" and insert therefor --the--.

Column 3, line 42, after the word "Figure", insert numeral --6--.

Claim 24, column 6, line 15, delete the word "of" first occurrence and insert therefor --at--.

Signed and Sealed this

Seventeenth Day of April, 1990

*Attest:*

HARRY F. MANBECK, JR.

*Attesting Officer*

*Commissioner of Patents and Trademarks*